United States Patent [19]

Engeler

[11] 4,165,780

[45] Aug. 28, 1979

[54] METHOD OF CONTINUOUSLY CASTING METALS, ESPECIALLY STEEL IN AN OSCILLATING MOLD

[75] Inventor: Walter Engeler, Lucerne, Switzerland

[73] Assignees: Belipar SA, Luxembourg, Luxembourg; Concast AG, Zurich, Switzerland

[21] Appl. No.: 859,454

[22] Filed: Dec. 12, 1977

[30] Foreign Application Priority Data

Dec. 28, 1976 [CH] Switzerland ..... 16379/76

[51] Int. Cl.[2] ..... B22D 11/04; B22D 11/10; B22D 27/00

[52] U.S. Cl. ..... 164/55; 164/66; 164/82; 164/83

[58] Field of Search ..... 164/55, 56, 57, 66, 164/82, 83, 4

[56] References Cited

U.S. PATENT DOCUMENTS

| | | | |
|---|---|---|---|
| 2,135,183 | 11/1938 | Junghans | 164/83 |
| 3,649,249 | 3/1972 | Halley et al. | 164/56 X |
| 3,700,024 | 10/1972 | Knell | 164/83 |
| 3,965,964 | 6/1976 | Fastner et al. | 164/83 |

FOREIGN PATENT DOCUMENTS

| | | | |
|---|---|---|---|
| 2528427 | 1/1976 | Fed. Rep. of Germany | 164/55 |

*Primary Examiner*—Othell M. Simpson
*Assistant Examiner*—Gus T. Hampilos
*Attorney, Agent, or Firm*—Werner W. Kleeman

[57] ABSTRACT

A method of continuously casting metals, in particular steel, especially continuously casting billets, wherein a multi-phase mixture composed of a liquid inert gas and a particulate additive is supplied into an oscillating continuous casting mold above the bath level thereof. According to the invention, during the casting operation, there is infed as the multi-phase mixture, liqid inert gas together with slag or flux powder in a quantity such that the layer thickness of the multi-phase mixture over the bath level is less than the length of the stroke of the oscillating mold.

4 Claims, 1 Drawing Figure

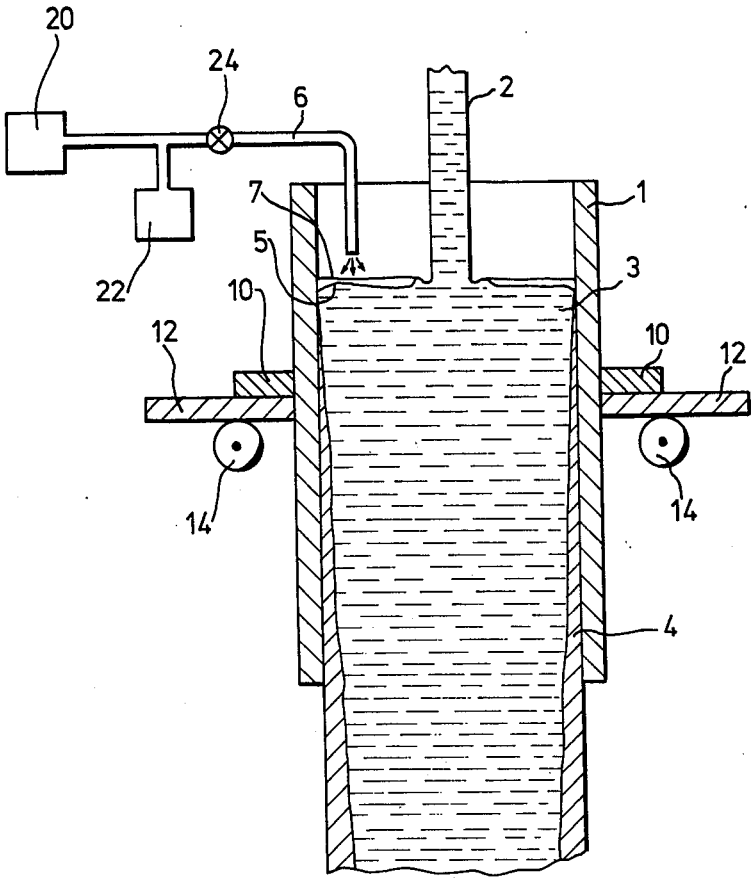
20
24
6
2
1
7
5
3
22
10
12
10
12
14
14
4

METHOD OF CONTINUOUSLY CASTING METALS, ESPECIALLY STEEL IN AN OSCILLATING MOLD

BACKGROUND OF THE INVENTION

The present invention relates to a new and improved method of continuously casting metals, especially steel, in particular to the continuous casting of billets wherein a multi-phase mixture composed of a liquid inert gas and a particulate additive is introduced into an oscillating continuous casting mold.

It is already known during the casting of steel to apply a flux or slag powder to the molten metal bath, the part of such flux powder in direct contact with the liquid steel melting and exerting a lubricating effect between the cast strand and the walls of the continuous casting mold. During casting of larger strand shapes or formats, there is usually employed in combination with the use of powder a pouring tube which protectively introduces the steel into the mold below the level of the molten bath and separates the flux powder and slag layer from the casting or teeming jet at the region of the bath level. During casting smaller shapes, for instance, billets, it is not readily possible to use pouring tubes, since owing to the given cross-section and the requisite wall thickness of the pouring tube, inadequate space remains between the pouring tube and the cooling mold walls. Therefore, at this location there is formed a bridge of non-molten flux powder and/or solidified steel which can lead to rupture of the casting. If, however, casting is accomplished without using a pouring tube and which flux powder, the drawback exists that the casting or teeming jet undesirably entrains slag particles into the interior of the casting or strand, thereby contaminating the steel. It is for this reason that smaller casting shapes are usually cast while using oil as a lubricant. Yet, when this technique is employed, on the one hand, the bath level no longer is protected from the oxygen contained in the air, and, on the other hand, this technique provides insufficient lubrication during casting, especially when casting free-cutting steel, since the oil is decomposed by the high temperature and the carbon-containing residues afford an inadequate lubrication action. Thus, surface defects appear at the cast strand, which especially during further processing of the strand, such as rolling and possibly drawing, can lead to fissures, and consequently, unusable cast products or only low-quality cast products. Furthermore the effect of the oil can produce so-called pinholes which also impair the quality of the surface of the strand. A further drawback during casting free-cutting steels with oil, especially lead-alloyed free-cutting steels, resides in that during casting there can periodically occur small explosions associated with material being ejected out of the continuous casting mold, thereby endangering the operating personnel.

It is already known to the art during continuous casting of a metal in a mold to use a homogeneous multi-phase mixture. Thus, a substance, for instance, carbon black particles, are introduced into a liquified inert gas, which substance is intended to facilitate the lubrication effect along the walls of the mold. The infed quantity of multi-phase mixture is especially critical when the casting parameters change, such as for instance the casting speed, since with improper calculation of such quantity there occurs either an inadequate lubrication or surface flaws at the cast product.

SUMMARY OF THE INVENTION

Hence, it is a primary object of the present invention to provide a new and improved method of continuously casting metals, especially steel, in a manner not associated with the aforementioned drawbacks and limitations of the prior art techniques.

Another and more specific object of the present invention aims at providing a new and improved method which enables continuously casting steel while obtaining a good lubrication effect in the mold and a relatively faultless surface of the casting and a high degree of purity thereof.

Another important object of the invention is to provide a novel method of continuously casting metals, especially steel, which affords enhanced safety for the operating personnel, especially when casting free-cutting steels.

Now in order to implement these and still further objects of the invention, which will become more readily apparent as the description proceeds, the method aspects of the present invention contemplate infeeding during the casting operation as the multi-phase mixture liquid inert gas together with flux powder in a quantity such that the layer thickness of the multi-phase mixture over the bath level is less than the length of the stroke of the oscillating mold.

With the infeed of flux powder to the liquid inert gas and the combined function as a multi-phase mixture there is achieved the beneficial result that the flux powder simultaneously spreads over the bath level. Upon vaporization of the liquid inert gas the flux powder drops onto the bath level, liquifies and can be easily drawn-in between the solidified strand and the walls of the mold. It is, however, essential that the thickness of the layer of the mixture which reposes upon the bath level is less than the stroke of the oscillating mold. If the layer thickness of the multi-phase mixture exceeds the length of the stroke of the oscillating mold, then the flux powder is not optimumly utilized because, as has been surprisingly determined, it adheres in the form of a crust at the cooling mold walls and causes inadequate lubrication and defects in the surface of the cast product. When practicing the method of the present invention there results, on the one hand, even when casting low-carbon steels, an outstanding surface at the billet, which is extremely important during the further processing of such casting, and, on the other hand, an extremely high degree of purity of the cast product. The liquid and vaporized inert gas also assumes the function of protecting the bath level and the casting jet from oxidation by the atmospheric oxygen. Hence, it is possible to dispense with the use of pouring tubes. Due to the omission of the heretofore conventionally used oil as the lubricant, there is achieved the advantageous result, especially when casting lead-alloyed free-cutting steels, that there do not occur explosions in the mold associated with ejection of material out of the mold.

It is advantageous if for each ton of cast steel there is added a quantity of 1–15 kg of liquid inert gas and a quantity of 0.01–0.2 kg flux powder as the multi-phase mixture. It is advantageous to continuously infeed the flux powder into a device, such as a conduit, which transports the liquified inert gas. Since the flux powder and the liquid inert gas impinge upon the bath level at the same location there is a good utilization of the distribution function of the gas.

There is advantageously used, especially when casting lead-allowed free-cutting steel, nitrogen as the liquid inert gas.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically shows a vertical sectional view of an oscillating continuous casting mold with infeed of the multi-phase mixture in accordance with the teachings of the present invention.

DETAILED DESCRIPTION OF THE PREFERRED EMBODIMENTS

Turning now to the drawing, it is to be understood that only enough of the structure of a continuous casting plant has been shown in the drawing to enable those skilled in the art to readily understand the underlying concepts and principles of the present invention. In the single FIGURE, a liquid metal, especially steel, flows from a not particularly shown tundish in the form of an open casting or teeming jet 2 into an oscillating continuous casting mold 1, typically for casting billets. At the region of the casting head or liquid metal pool 3 there begins the solidification of the steel into a shell or skin 4 having a thickness increasing in the lengthwise direction of the cast strand.

The continuous casting mold 1 is provided with a flange 10 connected with a mold table 12 which is oscillated by any suitable oscillating drive 14, such as an eccentric drive. During the casting operation there is infed a multi-phase mixture onto the bath level 5 by means of a suitable infeed device here in the form of a conduit or pipe 6. The multi-phase mixture consists of liquified inert gas and suspended therein molten solid particles advantageously in the form of flux powder. Hence, there is thus formed upon the bath level 5 a mixture in the form of a layer 7 composed of liquid and gaseous inert gas having suspended therein a small amount of flux powder. Importantly, this multi-phase mixture is infed in an amount such that the thickness of the layer 7 of the multi-phase mixture over the bath level 5 is less than the length of the stroke of the oscillating mold 1.

The liquid inert gas is infed into the the conduit 6 with the aid of a phase separator 20 which may be of the type disclosed in German patent publication No. 26 06 871, to which reference may be readily had and the disclosure of which is incorporated herein by reference. The flux powder is introduced into the conduit 6 by means of a low pressure-powder distributor 22, such as the commercially available powder distributor P 25/1.5 of the German firm Messer Griesheim, located at Krifteler Strasse 1, Frankfurt am Main, West Germany. Further, by manually actuating a valve 24 provided for the infeed conduit 6 there can be regulated the infed quantity of the multi-phase mixture.

Now according to an exemplary embodiment lead-alloyed free-cutting steel is cast into a continuous casting mold such as the oscillating mold 1, having a cross-sectional area of 115 $mm^2$. The mold 1 is oscillated by means of the oscillating drive 14 with a stroke of 15 mm, this drive 14, as explained, acting upon the mold flanges 10 connected to the mold table 12. During casting, liquid nitrogen is infed as the inert gas into the mold 1 by means of the common conduit or line 6 in an amount of 5 kg per ton of steel together with therein suspended flux powder in an amount of 0.03 kg per ton of steel. The inert gas, i.e., the liquid nitrogen, is infed by means of the aforementioned phase separator 20. The flux powder is delivered into the conduit 6 by means of the low pressure-powder distributor 22 and admixes with the liquid nitrogen. By manually operating the valve 24 it is possible to regulate, as mentioned, the delivered quantity of such multi-phase mixture. The thickness of the optically observed multi-phase layer 7, which rests as a cushion upon the bath level 5 of the mold 1, is maintained for instance at about 10 mm. The powder is uniformly transported over the bath level 5, due to vaporization of the liquid nitrogen deposits upon such bath level, liquifies, and is drawn into the gap between the mold walls and the solidified steel, thereby producing a good lubrication effect. The nitrogen which vaporizes protects both the bath level 5 and the casting jet 2 against atmospheric oxygen. Billets producted in this manner exhibit, following cooling thereof, an exceptionally good surface quality and internal purity i.e., lack of any pronounced inclusion of undesirably contaminants.

While there are shown and described present preferred embodiments of the invention, it is to be distinctly understood that the invention is not limited thereto, but may be otherwise variously embodied and practiced within the scope of the following claims.

Accordingly, what I claim is:

1. A method of continuously casting metals, in particular steel, especially for the casting of billets, comprising the steps of:

providing an oscillating continuous casting mold;

introducing molten metal into the continuous casting mold to form a bath level of molten metal therein;

applying a multi-phase mixture composed of a liquid inert gas and flux powder into the continuous casting mold in a manner such that the thickness of the layer of the multi-phase mixture deposited onto the bath level is less than the stroke of the oscillating mold.

2. The method as defined in claim 1, further including the steps of:

casting as the metal steel;

introducing as the multi-phase mixture during the continuous casting of the steel a quantity of 1–15 kg of liquid inert gas and a quantity of 0.01–0.2 of flux powder as the multi-phase mixture for each ton of steel.

3. The method as defined in claim 1, further including the steps of:

utilizing nitrogen as the liquid inert gas.

4. The method as defined in claim 1, further including the steps of:

casting as the metal lead-alloyed free-cutting steel; and using as the liquid inert gas nitrogen.

* * * * *